United States Patent [19]

Anderson

[11] 4,156,591

[45] May 29, 1979

[54] PUNCHED ORIFICE GAS INSPIRATOR

[76] Inventor: Thomas E. Anderson, 11200 N. Fairland Dr., South Lyon, Mich. 48178

[21] Appl. No.: 773,260

[22] Filed: Mar. 1, 1977

[51] Int. Cl.[2] ..... F23D 13/40

[52] U.S. Cl. ..... 431/354; 431/355; 239/567

[58] Field of Search ..... 431/354, 355; 239/566, 239/567, 568; 48/180 F, 18 P

[56] References Cited

U.S. PATENT DOCUMENTS

| | | | |
|---|---|---|---|
| 1,411,062 | 3/1922 | Needham | 48/180 |
| 2,044,528 | 6/1936 | Guhl | 431/355 |
| 2,494,243 | 1/1950 | Houlis | 431/354 |
| 3,034,733 | 5/1962 | Brooks et al. | 239/568 |
| 3,913,845 | 10/1975 | Tsuji | 239/567 |

*Primary Examiner*—Henry C. Yuen

*Attorney, Agent, or Firm*—David H. Semmes; Warren E. Olsen

[57] ABSTRACT

Gas burners, of the type employing atmospheric injection of combustion air and having a throat defining an inlet or mixing area and a plurality of burner ports defining an outlet area, particularly gas inspirators of the type having a plurality of peripheral orifices, so as to introduce pressurized gas into contact with atmospheric are. The inspirator is characterized both by the economic method of its construction, as well as its capability of adjustment to inspirate different types of fuels. In one embodiment, the inspirator conduit is axially adjustable with respect to the burner mixing throat, so as to regulate the injection of gas and mixing of gas with air prior to combustion. The inspirator in its multi-fuel mode has a plurality of series of axially spaced orifices, additional series being opened upon axial extension of the inspirator into the mixing throat.

11 Claims, 26 Drawing Figures

PUNCHED ORIFICE GAS INSPIRATOR

BACKGROUND OF THE INVENTION (1) Field of the Invention

The present invention relates to a new and useful device for controlling the amount of a gaseous fuel supplied to an appropriate fuel burner. Whereas the conventional approach to this function makes use of a machined orifice spud or orifice hood, with the metering orifice per se usually being a drilled (or otherwise machined) hole, the present punched orifice inspirator may be advantageously constructed from a short length of small diameter tubing with a plurality of suitably formed, punched openings around the periphery of the tube. Advantages of this device over the conventionally drilled or machined orifice include:

1. Lower cost.
2. A great reduction in the burner throat length required for fuel-air mixing and establishment of a satisfactory mixture flow profile.
3. The ability to inexpensively incorporate more than one set of orifices in a single part to allow its use on multiple fuel types and supply pressures.
4. The ability to economically pre-set the fuel-air ratio injected into the burner throat for more than one fuel type at time of manufacture. If desired, this pre-setting ability can, in many cases, obviate the need for additional (and costly) air control devices, e.g., shutters, sleeves, and the like.
5. Injection of more primary air into a short throat burner, than a drilled orifice can inject into a similar burner of conventional throat length.

(2) Description of the Prior Art

U.S. Patents

HAWK: No. 973,040
DEFOREST: No. 991,141
NEEDHAM: No. 1,411,062
BECKMAN: No. 2,187,010
FERREL: No. 2,513,087
WRIGHT: No. 2,631,659
LOVETT: No. 2,785,742
ANDERSON: No. 3,233,654
GUTH: No. 3,816,061

Both Hawk, 973,040, and DeForest 991,141, combine a series of spirally arranged apertures with an axially movable sleeve to "adjust" fuel flow. However, neither patentee addressed the problems of short throat operation or pre-set primary air control. Both Hawk and DeForest must rely upon high precision components to develop a seal between the movable and stationary elements. Also, the methods that both inventors employ to provide the stepwise opening function do not lend themselves to the small, compact and economic embodiments suggested herein.

Needham, 1,411,062, employs a simple orifice at nozzle 19. Therefore, it is not possible to reduce either the throat opening or mixing tube dimensions.

Beckman, 2,187,010, employs a simple orifice at 20 and, therefore, cannot reduce either the throat opening or the burner length. The mechanism used to control air injection (column 3, lines 41–51) is impingement of the fuel stream against the inner wall of the mixing chamber 10. In comparison, the jet issuing from the present punched orifice does not actually impinge on the inner throat wall. Also, note the large mixing chamber 10 necessary to the Beckman device.

Ferrel, 2,513,087, discloses jet orifices 19 which have the properties of the simple orifice with its dimension restrictions. The free jet nature of the flow from orifices 19 is obscured by the fact that Ferrel is using a combustion bowl 5 rather than a premix burner. In Ferrel the inner surface of the combustion zone will be located at those points where the speed of the mixture exiting the bowl 5 equals the local flame speed. According to Ferrel, this occurs essentially at the top of bowl 5 (Column 2, lines 47,48). While this effect gives the appearance of "short throat" operation, it is not. The quantity of entrained air as a function of distance from the Ferrel orifice 19 will be essentially identical to that of any simple orifice; in contrast, the quantity of entrained air as a function of distance from an Anderson punched orifice will be much, much larger (which results in the mixture velocity being much less).

In Anderson, 3,233,654, where a plurality of circular free jets are employed, vortex formation must necessarily be relied upon for creating the mixing profile to achieve a reduction in throat area and mixing length. By contrast, the present invention uses an easily adjustable form of attached jet, hence the present invention actually constitutes a replacement for a simple-orifice inspirator; and one with a particularly configured attached jet that obtains a momentum transfer much more efficient than that available from a simple orifice inspirator.

Wright shows a simple orifice 18*a* which will develop the flow pattern of a simple free jet. Depending upon the specific geometries employed, the diffusing bar 20 may increase the rate of air-fuel mixing over that of the simple free jet. This could, to a limited extent, allow a reduction in the required burner throat length; similar to the punched orifice inspirator. However, addition of a diffusing bar, especially in close proximity to the orifice as Wright suggests, will result in a very, very large reduction in the total quantity of primary air that can be injected (as compared to the same orifice without the diffusing bar). If the diffusing bar is placed close enough to the orifice to allow a significant reduction in throat length, the amount of primary air injected will be reduced below a level usable for general burner operation.

Lovett, 2,785,742, is not a gas inspirator pipe, it is a supply tube for compressed air (Column 2, lines 15–17). Hence, it is necessary to realize that this device is a *power* gas-air mixer, not an *atmospheric* inspirator. In order for the Lovett device to mix any appreciable quantity of air with the fuel, a source of compressed air must be provided (which atmospheric inspirators do not require). Lovett is concerned only with *mixing* fuel and air to form an homogeneous mixture: not with the delicate process of transferring momentum from a low energy fuel jet to the surrounding atmospheric air, which an *inspirator* must do.

The air scoops or louvered openings 36 that Guth, 3,816,061, employs in burner shroud 13 are not germane. Guth is providing these openings principally as a means of ingress for additional secondary air.

SUMMARY OF INVENTION

As will be apparent, the punched orifice, tubular gas inspirator (PTI) has been designed to function as an injector-mixer for use with modern atmospheric gas burners.

Nearly all gas-fired appliances that employ atmospheric operation rely on the simple drilled orifice inspirator (in its various forms) to inject a suitable air-fuel mixture into the burner. Common to all forms of these devices are restrictions in regard to the minimal physical dimensions of the burner that can be employed. The present device, which is itself a simple and low cost device, foreshortens the physical dimensions of the burner throat, in terms of both the area of the throat opening and the length of the mixing tube, necessary to allow adequate quantities of air to enter the burner and to ensure that a fully homogeneous air-fuel mixture reaches all burner ports. When the conventional simple orifice is employed, it is not possible to reduce either of these dimensions in a given application. The punched orifice inspirator, being a more efficient injector-mixer than is the simple orifice, makes feasible the reduction both of the throat area and especially of the mixing tube length. This results in two economies; first, there is a slight saving in the material required to fabricate the burner; and second, there is a very significant saving in the amount of material used in the applicance housing that contains the burner. To illustrate this second economy, one can consider, by way of example, a burner with a six inch long mixing tube being replaced by an equivalent burner with a two inch long mixing tube. The size of the entire appliance may then be reduced by about four inches with no change in performance. Such a reduction could not have been made, if a conventional orifice inspirator had been retained.

As indicated herein, it is possible to form the punched orifices of the new device at a radial angle, so that they are not coaxial with the tubular body. In this case vortex formation occurs, and would allow the required mixing tube to be shortened even below the one to two inch length which has been illustrated. However, the functioning of the new device is not dependent upon this feature.

The new device can be conveniently and economically packaged in three (3) primary forms: single fuel, multi-fuel, and stepwise adjustable. A sliding or axial adjusting feature is important to the second and third types. A unique feature of pre-setting the injected air-to-fuel ration, common to all three types, is important both to economy and simplicity of operation. By eliminating conventional air control devices, not only is the system cost lowered, but field problems associated with the correct adjustment and maintenance of such devices are eliminated. This feature is especially useful when a field conversion must be made from one fuel to another, e.g., L.P. to natural. Whether single fuel types are interchanged, or the position of a multi-fuel type is changed, factory personnel know that the correct mixture will be supplied. By not relying upon the judgement of field technicians to properly adjust primary air, the appliance can often be manufactured to more precise specifications. Of course, air control devices may also be employed, if desired.

The new device is intended primarily as an injector-mixer for use with atmospheric burners. Its desirable properties are the result of using a more efficient method of momentum transfer. Of the three primary forms of the device, pre-setting of the mixture is common to all three, axial movement is common to two.

BRIEF DESCRIPTION OF THE PREFERRED EMBODIMENTS

Figure 2A:
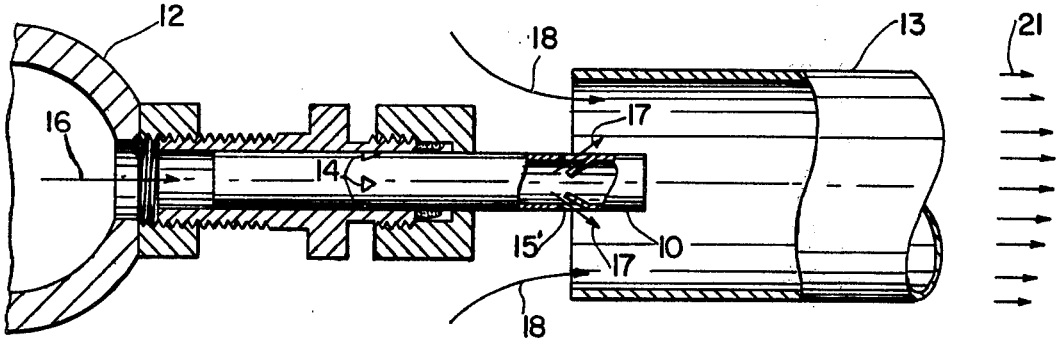
FIG. 2A is a fragmentary, enlarged section of an adjustable modification of invention where both a first series of punched orifices and a second series are available for introduction of gases into the mixing throat.
Figure 2B:
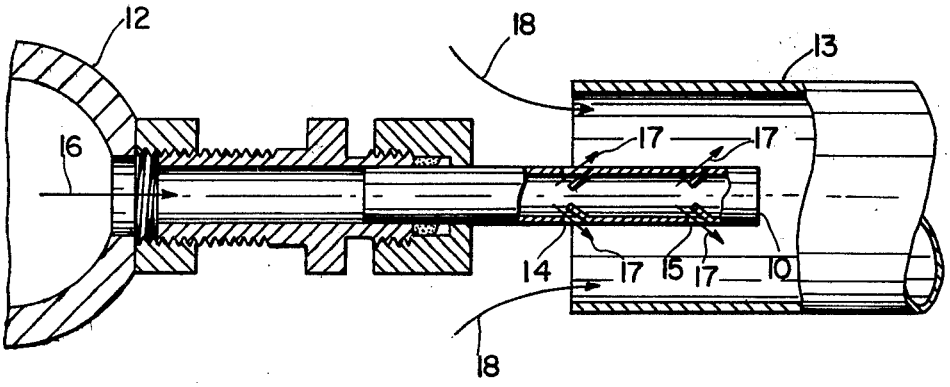
FIG. 2B is a view similar to FIG. 2A, showing axial extension of the inspirator, so as to expose both the first and second series in the mixing throat.
Figure 3A:
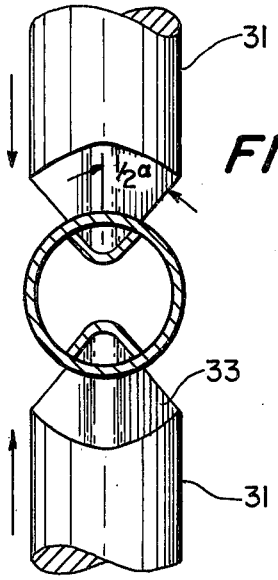
FIG. 3A is a vertical elevation, partially in section, showing punching of the orifices.
Figure 3B:
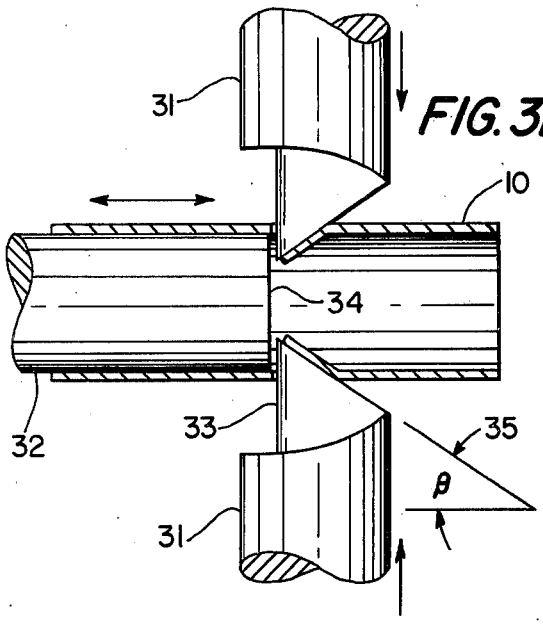
FIG. 3B is a side elevation, showing support of the inspirator upon a mandrel while punching the orifices.
Figure 4A:
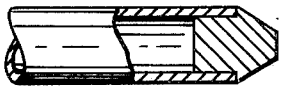
FIGS. 4A–4E show a variety of means of closing the end of the inspirator.
Figure 4B:
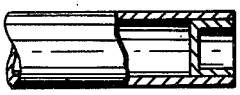
Figure 4C:
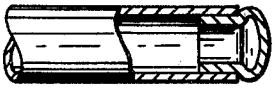
Figure 4D:
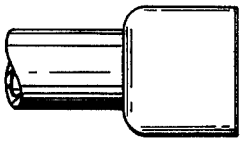
Figure 4E:
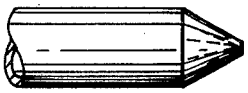
Figure 5A:
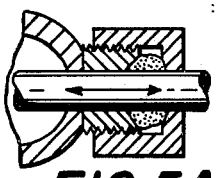
FIG. 5A shows a standard compression means for securing the inspirator to the source of gas.
Figure 5B:
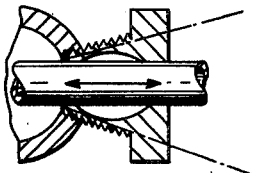
FIG. 5B shows a special compression means of securement.
Figure 5C:
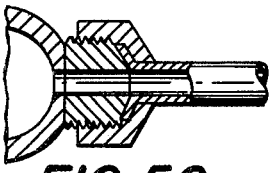
FIG. 5C shows a standard flare method of securement.
Figure 5D:
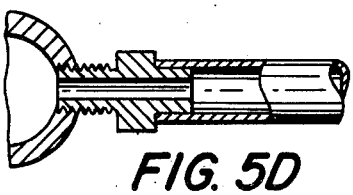
FIGS. 5D and 5E show a special swedge/weld securement.
Figure 5E:
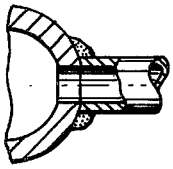
Figure 6A:
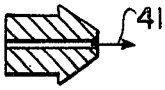
FIGS. 6A–E, respectively, show various means of providing a single axial orifice in the closed end modes of FIGS. 4A–E.
Figure 6B:
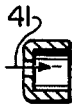
Figure 6C:
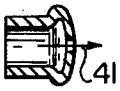
Figure 6D:
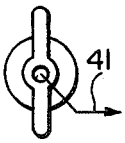
Figure 6E:
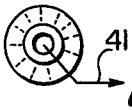

The punched orifice, tubular inspirator 10 is constructed from a length of light-wall tubing of suitable dimensions, by the method as illustrated in FIGS. 3A and 3B. Orifices 11 are conveniently formed by driving a suitably shaped punch 31 through the wall section at selected locations around the periphery of tubular conduit 10, being placed over an arbor 32, of dimension such that it forms a sliding fit with the inside diameter of the tube, so as to support the tube from collapse in opposing the action of the punch, and also to form a shearing edge, as opposed to the plane 33 of the punch which is normal to the periphery of the tube so positioned. The particular shape of punch 31 employed for this purpose will, in most applications, be extremely critical to the correct functioning of the device: however, to accommodate the multitude of varied applications for which this device is suitable and desirable, the punch 31 shape may include, but is not limited to, conic sections, pyramidal sections, or simple chisel-like forms. The exact number, location, and pattern of such orifices so formed will depend on, and be varied according to, the specific requirements of an appropriate application of the device. The plane of the punch 33 normal to the surface of the conduit 10 need not be limited to perpendicularity with the longitudinal axis of the tube. Also, the plane of the punch 33 which opposes the internal arbor 32 need not be limited to normality with the surfaces of conduit 10, but may be mutually inclined with the opposing surface 34 of the internal arbor 32 to some other angle suitable for a particular application. The inspirator device is connected to a suitable source of gaseous fuel, typically a manifold 12, in a desirable gas-tight manner as illustrated, but not limited to those methods, in FIGS. 5A–E. The injection end of the device directed toward a suitable burner 13 is closed in a gas-tight manner as illustrated, but not limited to those methods, in FIGS. 4A–E. Also, as a variation when the application makes it desirable to do so, this end-closure of the device may be equipped with an additional orifice 41, or set of orifices, formed in a more conventional manner: illustrated but not limited to those forms, in FIGS. 6A–E. For applications which may require the appliance to operate on more than a single type of fuel, or at more than a single supply pressure, a second series of orifices 14 may be similarly formed within conduit 10 at a point axially spaced from orifices 15, as shown in FIGS. 2A, 2B. When it is desired that the second orifices are not to pass fuel into the burner they are sealed in a suitable gas-tight manner as illustrated, by way of example, in FIGS. 7 and 2A.

Figure 1:
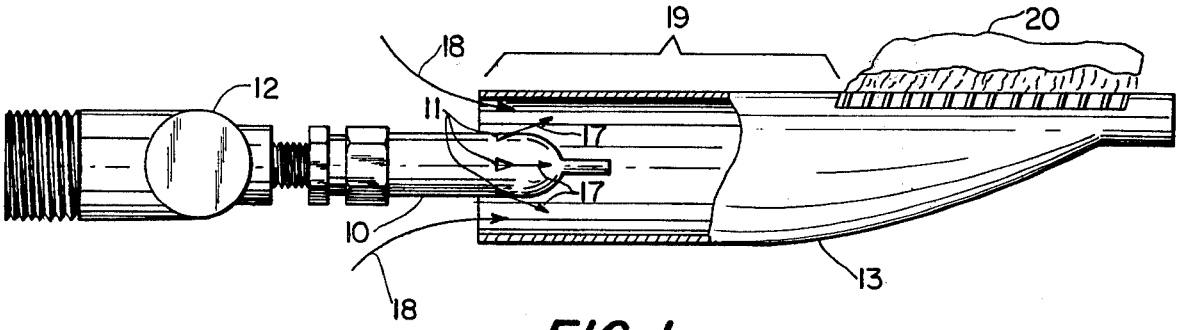
FIG. 1 is a vertical elevation, partially in section, showing a punched orifice gas inspirator, according to the present invention, positioned within the mixing throat of a gas burner.

FIG. 1 illustrates a complete burner assembly, with one form of inspirator, according to the present invention. Gaseous fuel, 16, within the supply line 12, being at a pressure above the surrounding atmosphere, will flow down the length of the tubular inspirator 10 to those orifices which are open to the atmosphere. Fuel will then flow through the open orifice(s) in a controlled and predictable manner: the quantity of such fuel being approximately proportional to the open area of the orifices. Fuel 17 flowing through the open orifices 11 into the burner 13 will entrain and mix with air 18 from the surrounding atmosphere. The resulting air-fuel mixture will then flow down the throat 19 of the burner and out through the burner ports into the combustion zone 20. The flow area of the open orifices, e.g., 15 in FIG. 2, can be conveniently pre-set by varying the number of such orifices, the depth to which the punch 31 of FIG. 3 penetrates the tube wall, and/or the shape of the punch face 33 presented to the arbor face 34. If it is desired to operate the appliance on a different fuel-type with lower heating value and/or lower supply pressure, in lieu of replacing the inspirator with a second inspirator having the desired orifice area, the inspirator may be axially withdrawn slightly from its gas-tight fitting, for example, as illustrated in FIG. 2B, to expose a second series of orifices 14, perhaps having different cross sectional areas from the first set(s) of orifices 15, which will then supply the desired additional quantity of fuel to the burner. If adjustable regulation of fuel quantity 17 is required, orifices, or groups of orifices, may be arranged linearly or spirally down the length of the inspirator tube, and exposed to the atmosphere in a stepwise fashion to obtain the desired fuel quantity.

As will be apparent, the ratio of the injected primary air to fuel gas in the mixture flowing into the burner can be conveniently and accurately pre-set at time of manufacture for each orifice, or series of orifices, by selecting the desired injection angle (35) for the punch 31 used to form a particular orifice. In general, the ratio of injected primary air to fuel in the mixture will be proportional to the cosine of the injection angle (35) measured as shown. Different orifices, or groups of orifices, in the same inspirator, may be fabricated with different injection angles to suit the particular application. In direct contrast to the conventional machined-orifice inspirator, fuel 17 exiting the open orifices thoroughly mixes with the injected air 18 within an extremely short distance from the orifice.

As illustrated in FIG. 2A, it is due to this vigorous injecting and mixing ability, that the fuel-air mixture flowing down the burner throat 19 transforms to a developed flow of uniform velocity profile 21 in a very short distance from the inspirator. This allows the throat length 19 of the burner necessary to stable burner performance to be reduced to typically one to two throat diameters in length.

Figure 7:
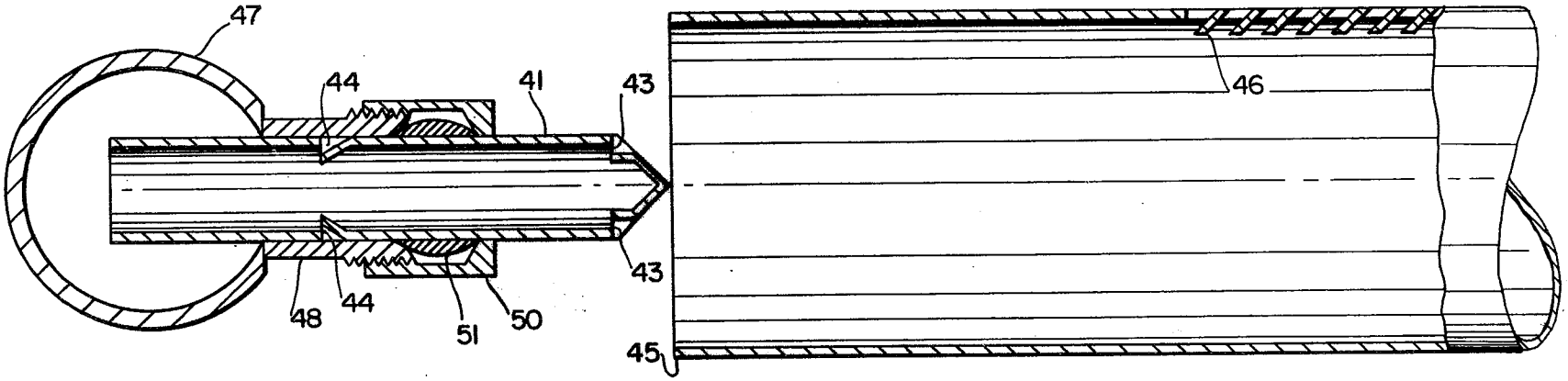
FIGS. 7 and 8 are fragmentary longitudinal sections, showing a multi-fuel inspirator in two modes, preferentially configured for propane and natural gas fuels, respectively.
Figure 8:
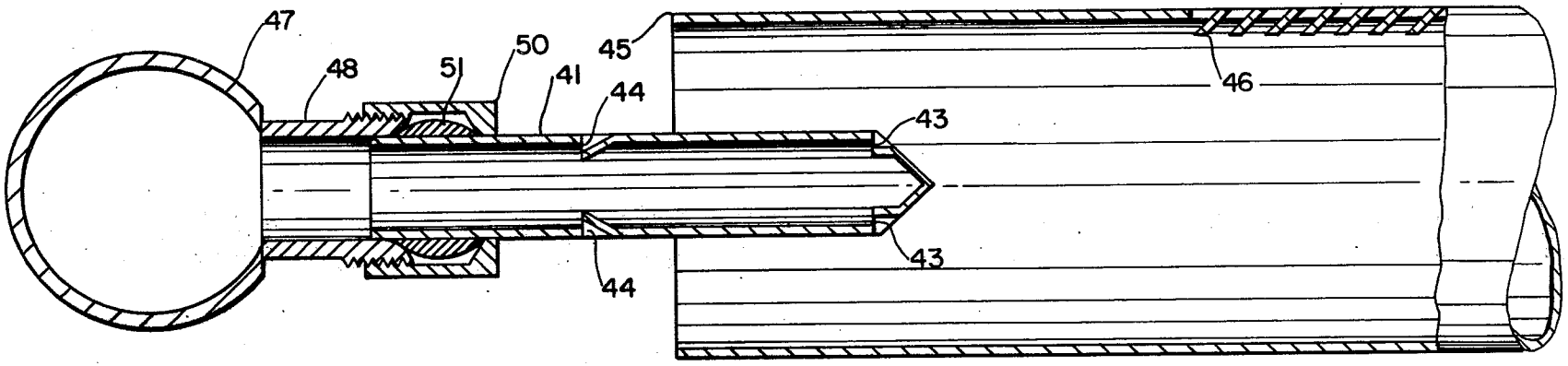

FIGS. 2A and 2B illustrates an embodiment where the first set of orifices, 15, and the second set of orifices, 14, allow the burner to operate on either more than a single type of fuel, or allow an adjustment of the nozzle, for example, for more than a single supply pressure of a given type of gaseous fuel. The locking collar allows the inspirator, 10, to be axially adjustable, so that any number of orifices, or sets of orifices, may be introduced axially into the burner throat, 19. If the gaseous fuel is natural gas, for example, the FIG. 2A position is advantageous for higher gas supply pressures, and the FIG. 2B position is advantageous for lower supply gas pressures. The embodiment show both in FIGS. 7 and 8 illustrates a multifuel type, in two modes. The inspirator 41 is held within a gas manifold 47 through the provision of a locking collar 50, which also advantageously includes a seal 51. The inspirator 41 includes a first set of orifices, 43, punched so as to define an essentially axial introduction of gaseous fuel inside of the burner throat. The burner throat is that length of the tube up to the burner ports, shown at 46. As shown in FIG. 7, the first set of orifices, 43, are advantageously configured for a gaseous fuel such as propane. The second set of orifices, 44, may be exposed in the position shown in FIG. 8 for inspirating a gaseous fuel such as natural gas. The second set of orifices, 44, are shown with different injection angles from the angles of injection of the first set of orifices, 43, to enhance air inspiration when this embodiment is changed, for example, from propane fuel to natural gas. The embodiment in FIG. 9 shows a single fuel type, having axial ports, 43, for most efficient inspiration of the propane and air into the burner throat.

Figure 9:
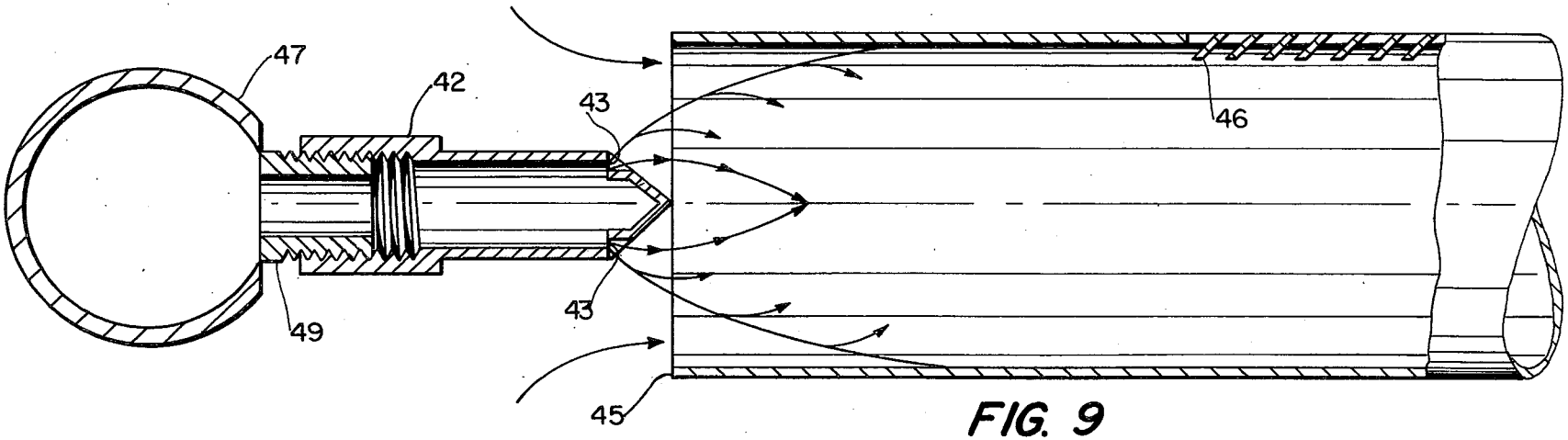
FIG. 9 is a showing of a single fuel type, such as propane, having axial ports, injecting incoming air with propane.
Figure 10:
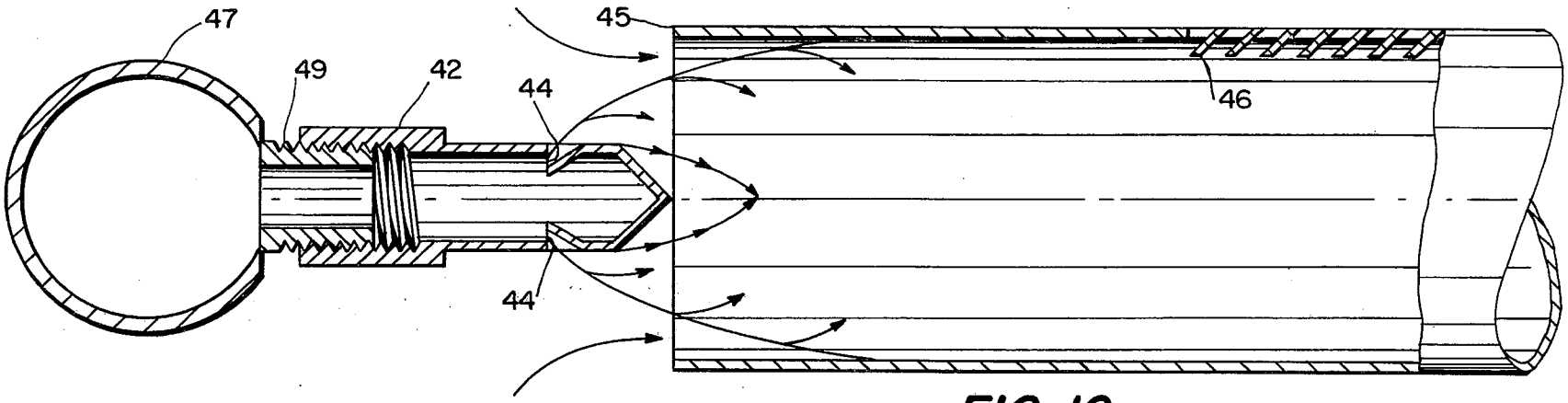
FIG. 10 is a showing of a single fuel type, such as natural gas, radially angular orifices for the mixing of natural gas with air.

In this single-fuel embodiment of FIG. 10, the punched orifices, 44, are inclined for most efficient injection of a fuel such as natural gas, and it should be appreciated that the supply manifold 47 and male thread portion 49 are the same for the embodiments of FIG. 9 and FIG. 10. For both the propane inspirator of FIG. 9, and the natural gas inspirator of FIG. 10, there is a commonly configured nut, 42, thereby allowing quick replacement of the inspirator within a given burner throat as fuels are changed.

Figure 11:
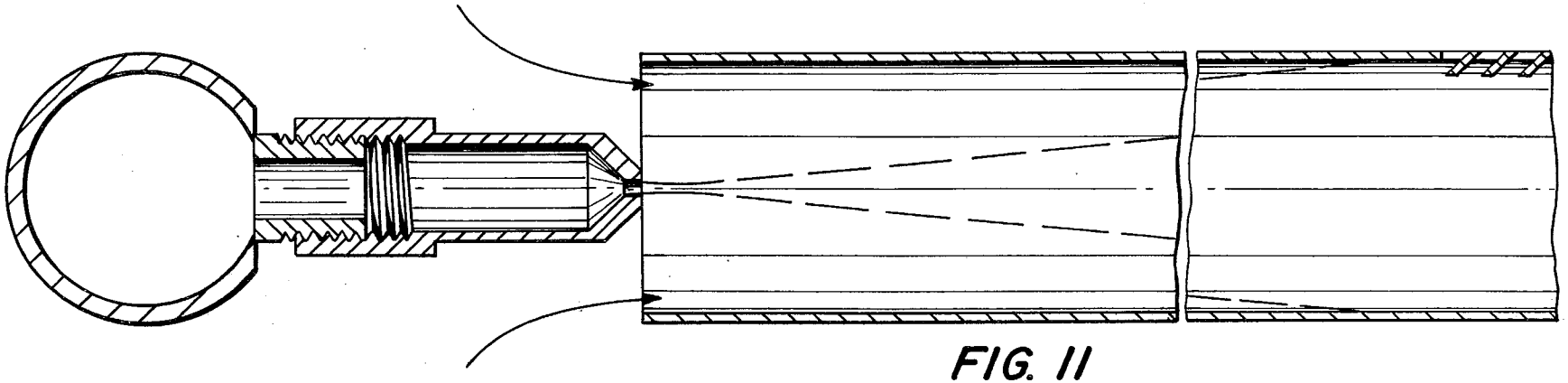
FIG. 11 illustrates a conventional simple free jet.

FIG. 11 illustrates a prior art and conventional type of inspirating orifice, particularly a free-jet type which defines a conical gaseous fuel profile, as illustrated in dotted line. Such conventional orifices require the burner to have a throat dimension, or mixing length, which is at least five times the diameter of the throat. As shown in FIG. 1, the burner 13 has a throat length, 19, with the throat length 19 being defined as the distance from the inlet of the burner to the first of the burner ports 20. It is axiomatic that the gas/air mixture must be completely mixed by the time any of the mixture is allowed to exit burner 13, through the burner ports, 20.

Figure 12:
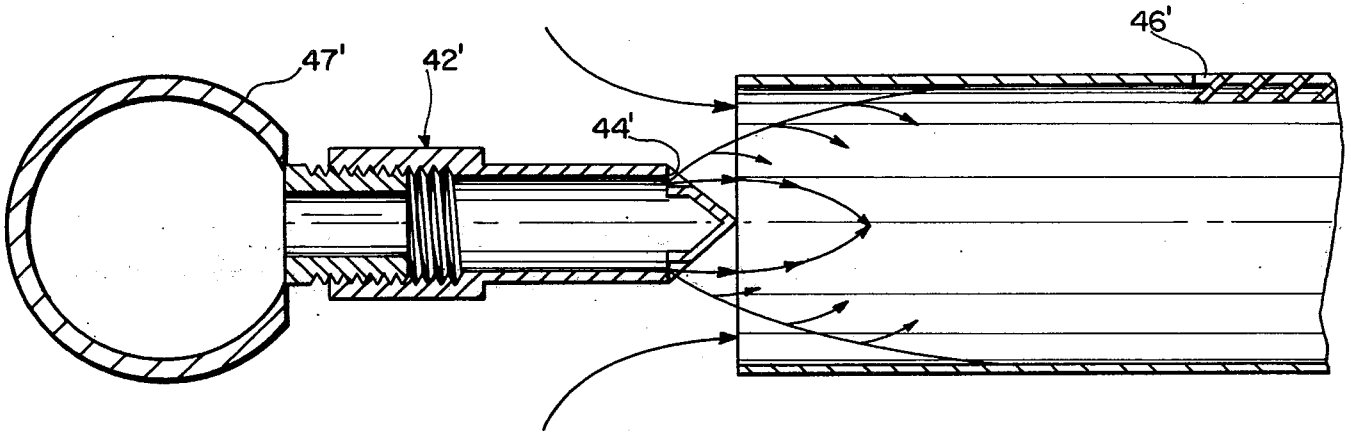
FIG. 12 shows the reduced burner throat length achieved in contrast to FIG. 11.

Hence, as shown in FIG. 11, the conical profile of the gas issuing from the simple jet-type of orifice has completely difused at the beginning of the first burner port. The length from the inlet of the burner to the first burner port is conventionally known to be at least five times the diameter of the burner type. By contrast, as shown in FIG. 12, the mixing length, or burner throat, can be significantly reduced in size, for example, to between one or two times the diameter of the burner tube. In FIG. 12 the length of the burner throat, i.e., the distance from the inlet of the burner tube to the first burner port, 46, may typically be 1.5 times the diameter of the burner tube according to the principles of the present invention.

As will be apparent, the present device has been designed primarily for use with tubular sheet metal burners; however, it will be apparent it may be also applied to other types of atmospheric burners, such as range top and oven burners. Manifestly, the inspirator may be varied, and the orifices variously constructed, without departing from the spirit of the invention, as claimed.

I claim:

1. In a gas burner of the type including an elongated chamber with a throat portion having open inlet for mixing of air at one end and a plurality of axially spaced burner ports defining individual outlets at the other end, a gas inspirator comprising:

(A) A base portion communicating with a source of pressurized gas;

(B) An inspirator conduit having an inlet end axially adjustably supported in said base, in communication with said source of pressurized gas and having an outlet end extending into the throat portion of said burner, so as to advance gas to an area of mixing with air entering through said open inlet of said throat portion, said inspirator conduit including a plurality of angular orifices punched in its periphery adjacent said open inlet; said orifices as a first series defining within said inspirator conduit a plurality of individual shields so as to trap and guide advancing gas through individual said orifices and into said throat mixing portion; said inspirator conduit being supportable with respect to elongated chamber, such that said angular orifices are adjacent said open inlet; and said inspirator onduit being axially advanceable, such that said angular orifices are positioned inwardly of the throat portion and away from said open inlet; and (C) A seal securing said inspirator to said base.

2. A gas inspirator as in claim 1, including a second series of peripheral orifices axially spaced from the first series orifices and, being axially advanceable into said throat mixing portion, so as to provide additional gas inspirating orifices.

3. A gas inspirator as in claim 2, said inspirator being axially extendable from said base so as to expose said second series of orifices within said inlet.

4. A gas inspirator as in claim 3, said second series of orifices being positioned adjacent said open inlet.

5. A gas inspirator as in claim 2, wherein said first series and second series define, respectively, propane and natural gas orifices.

6. A gas inspirator as in claim 5, wherein said propane orifices are axially punched at the end of said inspirator conduit nearest said open inlet and said natural gas orifices are punched in a median portion of said inspirator conduit, said natural gas orifices being sealed within said base, unless axially extended into said throat mixing portion adjacent said open inlet.

7. A gas inspirator as in claim 6, wherein said propane orifices in said first series and said natural gas orifices in said second series have differing cross sectional areas.

8. A gas inspirator as in claim 1, wherein the length of said throat mixing portion is approximately 1½ times the diameter of said throat mixing portion.

9. A gas inspirator as in claim 1, wherein said punched orifices are triangular in cross section.

10. A gas inspirator as in claim 1, wherein said punched orifices are semi circular in cross section.

11. A gas inspirator as in claim 1, wherein the length of said throat mixing portion is on the order of 1.5 times the diameter of said throat mixing portion.

* * * * *